US011201417B1

(12) United States Patent
Chen

(10) Patent No.: US 11,201,417 B1
(45) Date of Patent: Dec. 14, 2021

(54) WIRING TERMINAL

(71) Applicant: Xiamen Ghgm Electric Co., Ltd., Xiamen (CN)

(72) Inventor: Bingshui Chen, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 0 days.

(21) Appl. No.: 17/027,706

(22) Filed: Sep. 22, 2020

(30) Foreign Application Priority Data

Aug. 19, 2020 (CN) ..... 202021755707.0

(51) Int. Cl.
*H01R 4/48* (2006.01)
*H01R 11/22* (2006.01)
*H01R 4/22* (2006.01)

(52) U.S. Cl.
CPC ..... *H01R 4/4836* (2013.01); *H01R 11/22* (2013.01); *H01R 4/22* (2013.01); *H01R 4/4845* (2013.01)

(58) Field of Classification Search
CPC ... H01R 4/4836; H01R 4/4818; H01R 4/4845
See application file for complete search history.

(56) References Cited

U.S. PATENT DOCUMENTS 10,236,597 B2 * 3/2019 Meyer ..... H01R 4/4836

* cited by examiner

*Primary Examiner* — Ross N Gushi

(57) ABSTRACT

A wiring terminal includes a housing, a clamping and connecting piece, and a pressing piece. The housing is provided with a mounting channel and an insertion hole communicating with the mounting channel. The clamping and connecting piece is provided with a curved spring plate for clamping a conducting wire and a conductive sheet. The spring plate has a natural state in which the conducting wire placed in the mounting channel is clamped between the spring plate and the conductive sheet through elastic abutment, and a pressed state in which the spring plate is controlled by external force to deform in a direction distal from a clamped conducting wire. The pressing piece is capable of triggering the spring plate to switch between the natural state and the pressed state to unclamp the conducting wire.

8 Claims, 7 Drawing Sheets

WIRING TERMINAL

CROSS REFERENCE TO RELATED APPLICATION

This application claims all benefits accruing under 35 U.S.C. § 119 from China Patent Application No. 202021755707.0, filed on Aug. 19, 2020 in the China National Intellectual Property Administration, the content of which is hereby incorporated by reference.

TECHNICAL FIELD

The present invention relates to the technical field of electric wiring apparatuses, and specifically, to a wiring terminal.

BACKGROUND ART

A wiring terminal is a wiring apparatus that can be used for disassembling and assembling an external conducting wire. At present, the wiring terminal generally presses an inserted conducting wire by using an internal clamping and connecting piece to implement an electrical connection. During use, a plurality of conducting wires are separately inserted into a housing, and a mutual electrical connection between the inserted conducting wires is implemented when the clamping and connecting piece is used for pressing. When the conducting wire needs to be drawn away, the conducting wire may be directly drawn away to make the clamping and connecting piece elastically deform, so as to implement detachment of the conducting wire. The current wiring terminal is not conducive to insertion or drawing away of the conducting wire. During use, the conducting wire needs to be inserted or drawn away frequently, which results in a relatively unstable clamping and connecting piece, thereby affecting clamping, disassembly, and assembly of the conducting wire, and making the wiring terminal fail to work normally and efficiently. In view of this, an inventor puts forward this application after researching the prior art.

SUMMARY

The present invention discloses a wiring terminal, to resolve a problem that it is inconvenient to disassemble and assemble a conducting wire for an existing wiring terminal.

The present invention uses the following solutions:

This application provides a wiring terminal, used for inserting and connecting to a conducting wire, and including: a housing, a clamping and connecting piece, and a pressing piece. The housing is provided with a mounting channel and an insertion hole communicating with the mounting channel. The clamping and connecting piece is configured in the mounting channel. The clamping and connecting piece is provided with a spring plate and a conductive sheet cooperating with the spring plate. The spring plate is used for clamping the conducting wire, and is curved. The spring plate has two states: a natural state and a pressed state. In the natural state, the spring plate clamps, between the spring plate and the conductive sheet through elastic abutment, the conducting wire placed in the mounting channel. In the pressed state, the spring plate is controlled by external force to deform in a direction distal from a clamped conducting wire. The pressing piece is capable of correspondingly triggering the spring plate to perform switching between the natural state and the pressed state.

The conducting wire is capable of passing through the insertion hole, and is clamped in the clamping and connecting piece. The pressing piece triggers the spring plate to switch from the natural state to the pressed state, to unclamp the conducting wire, so that the conducting wire is detachable from the clamping and connecting piece, to facilitate drawing away the conducting wire.

In a further improvement, each of the spring plate and the conductive sheet is provided with an opening, and the openings are provided opposite to each other and are assembled, so that the spring plate and the conductive sheet form a ring-shaped bend; an end portions of the spring plate is connected to an inner end surface of the conductive sheet through elastic abutment, and the conducting wire is passable through the end portion of the spring plate to be clamped between the spring plate and the conductive sheet.

In a further improvement, the spring plate is U-shaped, and includes a support portion, a bow-shaped portion, and a clamping portion; the support portion leans against the conductive sheet, the bow-shaped portion is connected to the support portion, and the clamping portion is connected to the bow-shaped portion, and is provided with a free end in a direction of the conductive sheet; a U-shaped opening is formed between the clamping portion and the support portion.

In a further improvement, the conductive sheet is C-shaped, and includes a mounting portion that fits and clamps the support portion, a connecting portion connected to the mounting portion, and a conductive portion connected to the connecting portion; the conductive portion abuts against the free end of the clamping portion; a C-shaped opening is formed between the conductive portion and the mounting portion.

In a further improvement, the bow-shaped portion and the connecting portion are disposed opposite to each other, and the clamping portion is roughly obliquely disposed, so that an included angle less than 90° is formed between the free end of the clamping portion and the conductive portion.

In a further improvement, the connecting portion is correspondingly provided with a wire passing window along the mounting channel, the support portion is passable through the wire passing window to close-fit the mounting portion, and the support portion fits the mounting portion through buckling for fixing; at least a part of the support portion extends out of the wire passing window along an insertion direction of the conducting wire.

In a further improvement, an inner end surface of the conductive portion is provided with a limiting groove, and the limiting groove corresponds to the free end of the clamping portion; when the spring plate is in the natural state, the free end is clamped and limited in the limiting groove, and the limiting groove is transitionally connected to a guiding slope surface along a direction in which the free end detaches from the limiting groove.

In a further improvement, the pressing piece is rotatably assembled in the housing, the pressing piece includes a pressing handle and a pressing head connected to the pressing handle, and the pressing handle is hingedly connected to the housing through cooperation of a rotating shaft, so that the pressing handle is rotatable relative to the housing, to correspondingly drive the pressing head to trigger the spring plate to switch a status of the spring plate.

In a further improvement, the pressing head is linked to the spring plate by using a limiting sheet, the limiting sheet and the pressing head are in a mutually abutting state throughout, and the limiting sheet has a first location and a second location; at the first location, the limiting sheet abuts against the pressing head; at the second location, the limiting sheet prevents the pressing head from continuing rotating along a rotation direction of the pressing handle, to limit an angle of upward or downward hinged rotation of the pressing handle.

In a further improvement, the housing includes a front end cover and a rear end cover, the two end covers are assembled and connected by using a quick disassembly piece, and the insertion hole is provided in the rear end cover, and is passable through, via the mounting channel, an inner cavity formed by assembling the two end covers.

Based on the foregoing technical solutions, the present invention may obtain the following technical effects:

In the wiring terminal in this application, the spring plate and the conductive sheet of the clamping and connecting piece cooperate with each other, the spring plate is correspondingly in the natural state when the conducting wire is placed in the mounting channel, and the conducting wire is clamped between the spring plate and the conductive sheet through elastic abutment, thereby ensuring stable clamping of the clamping and connecting piece, to implement a stable electrical connection between conducting wires. When the conducting wire needs to be drawn away, the pressing piece triggers the spring plate to perform switching from the natural state to the pressed state. In this case, the spring plate is pressed by the pressing piece to deform along a direction distal from the clamped conducting wire, to unclamp the conducting wire, and facilitate drawing away the conducting wire, thereby avoiding damage to the conducting wire and the spring plate caused by direct drawing away, and incomplete close-fitting between the spring plate and the clamping and connecting piece and impact on an electrical connection between conducting wires that are caused by directly pushing the spring plate by using the conducting wire to be clamped in the clamping and connecting piece.

Furthermore, in the clamping and connecting piece, the U-shaped spring plate and the C-shaped conductive sheet are disposed opposite to each other and are assembled through the openings, so that the spring plate and the conductive sheet are disposed opposite to each other to form a ring-shaped bend, which facilitates elastic abutment and firm clamping of the conducting wire in the ring-shaped bend. One end of the spring plate elastically abuts against the inner end surface of the conductive sheet, so that the inserted conducting wire can pass through the end portion of the spring plate and effectively deform elastically in the ring-shaped bend, to be clamped between the spring plate and the conductive sheet, thereby ensuring a more stable electrical connection.

BRIEF DESCRIPTION OF THE DRAWINGS

In order to illustrate the technical solutions of the embodiments of the present disclosure more clearly, the drawings used in the embodiments will be briefly described below. It shall be understood that the following drawings illustrate only certain embodiments of the present disclosure. Therefore, it should not be deemed as limiting the scope, and those skilled in the art may obtain other related drawings according to these drawings without any creative work.

DETAILED DESCRIPTION

Figure 1:
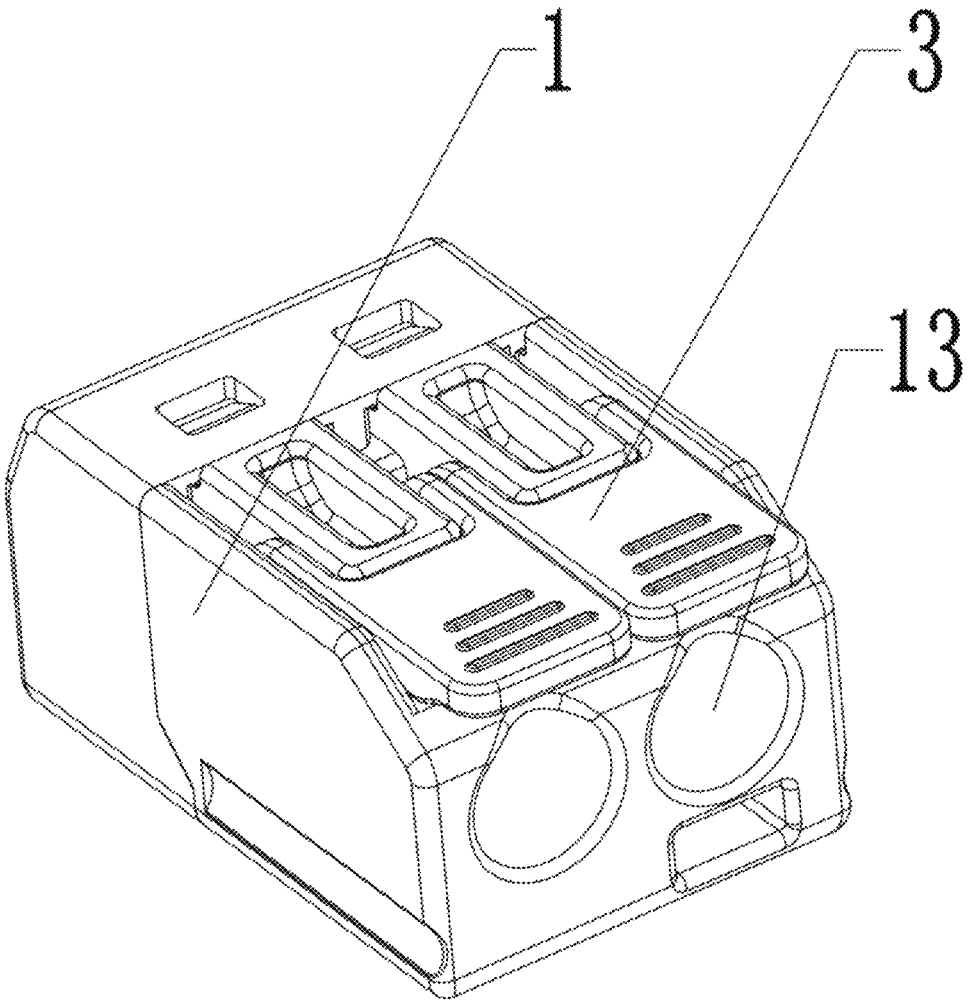
FIG. 1 is a schematic structural diagram of a wiring terminal according to an embodiment of the present invention.

The embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure.

With reference to FIG. 1 to FIG. 10, this embodiment provides a wiring terminal, used for inserting and connecting to a conducting wire, and including: a housing 1, a clamping and connecting piece 2, and a pressing piece 3. The housing 1 is provided with a mounting channel (not shown in the figure) and an insertion hole 13 communicating with the mounting channel. The clamping and connecting piece 2 is configured in the mounting channel. The clamping and connecting piece 2 is provided with a spring plate 21 and a conductive sheet 22 cooperating with the spring plate 21, and the spring plate 21 is used for clamping the conducting wire, and is curved. The spring plate 21 has two states: a natural state and a pressed state. In the natural state, the spring plate 21 clamps, between the spring plate 21 and the conductive sheet 22 through elastic abutment, the conducting wire placed in the mounting channel. In the pressed state, the spring plate 21 is controlled by external force to deform in a direction distal from a clamped conducting wire. The pressing piece 3 is capable of correspondingly triggering the spring plate 21 to perform switching between the natural state and the pressed state. The conducting wire is capable of passing through the insertion hole 13, and is clamped in the clamping and connecting piece 2. The pressing piece 3 triggers the spring plate 21 to switch from the natural state to the pressed state to unclamp the conducting wire, so that the conducting wire is detachable from the clamping and connecting piece 2.

In this embodiment, the spring plate 21 and the conductive sheet 22 of the clamping and connecting piece 2 cooperate with each other, the spring plate 21 is correspondingly in the natural state when the conducting wire is placed in the mounting channel, and the conducting wire is clamped between the spring plate 21 and the conductive sheet 22 through elastic abutment, thereby ensuring stable clamping of the clamping and connecting piece 2, to implement a stable electrical connection between conducting wires. When the conducting wire needs to be drawn away, the pressing piece 3 triggers the spring plate 21 to switch from the natural state to the pressed state. In this case, the spring plate 21 is pressed by the pressing piece 3 to deform along a direction distal from the clamped conducting wire, to unclamp the conducting wire, and facilitate drawing away the conducting wire, thereby avoiding damage to the conducting wire and the spring plate 21 caused by direct drawing away, and incomplete close-fitting between the spring plate and the clamping and connecting piece and impact on an electrical connection between conducting wires that are caused by directly pushing the spring plate 21 by using the conducting wire to be clamped in the clamping and connecting piece 2.

In one implementation, each of the spring plate 21 and the conductive sheet 22 is provided with an opening, and the openings are provided opposite to each other and are assembled, so that the spring plate 21 and the conductive sheet 22 form a ring-shaped bend. One end portion of the spring plate 21 is connected to an inner end surface of the conductive sheet 22 through elastic abutment, and the conducting wire is passable through the end portion of the spring plate 21 to be clamped between the spring plate 21 and the conductive sheet 22. The spring plate 21 is U-shaped, and includes a support portion 211, a bow-shaped portion 212, and a clamping portion 213. The support portion 211 leans against the conductive sheet 22, the bow-shaped portion 212 is connected to the support portion 211, and the clamping portion 213 is connected to the bow-shaped portion 212, and is provided with a free end 2131 in a direction of the conductive sheet 22. A U-shaped opening is formed between the clamping portion 213 and the support portion 211. Correspondingly, the conductive sheet is C-shaped, and includes a mounting portion 221 that fits and clamps the support portion 211, a connecting portion 222 connected to the mounting portion 221, and a conductive portion 223 connected to the connecting portion 222; the conductive portion 223 abuts against the free end 2131 of the clamping portion 213. A C-shaped opening is formed between the conductive portion 223 and the mounting portion 221. It should be mentioned that the bow-shaped portion 212 is roughly U-shaped, and parts of the spring plate 21 are transitioned through arc segments, to ensure elastic force of the clamping portion 213 in a structure of the spring plate 21, and opposite cooperation with a structure of the conductive sheet 22.

Furthermore, in the clamping and connecting piece 2, the U-shaped spring plate 21 and the C-shaped conductive sheet 22 are disposed opposite to each other and are assembled through the openings, so that the spring plate 21 and the conductive sheet 22 are disposed opposite to each other to form a ring-shaped bend, which facilitates elastic abutment and firm clamping of the conducting wire in the ring-shaped bend. One end of the spring plate 21 elastically abuts against the inner end surface of the conductive sheet 22, so that the inserted conducting wire can pass through the end portion of the spring plate 21 and effectively deform elastically in the ring-shaped bend, to be clamped between the spring plate 21 and the conductive sheet, thereby ensuring a more stable electrical connection.

In an embodiment, the bow-shaped portion 212 and the connecting portion 222 are disposed opposite to each other, and the clamping portion 213 is roughly obliquely disposed, so that an included angle less than 90° is formed between the free end 2131 of the clamping portion and the conductive portion 223. The included angle between the free end 2131 and the conductive portion 223 ranges between 30° and 60°. The conducting wire enters the mounting channel along the insertion hole 13 and can be more smoothly clamped in the clamping and connecting piece 2 along the included angle between the free end 2131 and the conductive portion 223.

In an embodiment, the connecting portion 222 is correspondingly provided with a wire passing window 2221 along the mounting channel, and the conducting wire inserted in and connected to the clamping and connecting piece 2 can extend out of the wire passing window 2221, thereby preventing the conducting wire from being bent. The support portion 211 is passable through the wire passing window 2221 to close-fit the mounting portion 221, and the support portion 211 fits the mounting portion 221 through buckling for fixing. At least a part of the support portion 211 extends out of the wire passing window 2221 along an insertion direction of the conducting wire. Specifically, either of the support portion 211 and the mounting portion 221 is provided with a convex 23, and the other is provided with a groove hole 24 for clamping and limiting the convex 23, so that the support portion 211 and the mounting portion 221 are mutually clamped and limited, and correspondingly the conductive portion 223 and the free end 2131 of the clamping portion 213 are mutually clamped and limited, to implement an assembly manner in which the spring plate 21 and the conductive sheet 22 are ring-shaped bends, thereby stabilizing and facilitating elastic deformation of the spring plate 21 caused by external force.

In an embodiment, an inner end surface of the conductive portion 223 is provided with a limiting groove 2231, and the limiting groove 2231 corresponds to the free end 2131 of the clamping portion 213. When the spring plate 21 is in the natural state, the free end 2131 is clamped and limited in the limiting groove 2231, and the limiting groove 2231 is transitionally connected to a guiding slope surface 2232 along a direction in which the free end 2131 detaches from the limiting groove 2231. The spring plate 21 is clamped in the limiting groove 2231 when the spring plate 21 is in the natural state, thereby preventing the spring plate 21 from continuously moving outwards, so that assembly of the spring plate 21 and the conductive sheet 22 facilitates stabilization of the clamping and connecting piece 2. In addition, the limiting groove 2231 is located on a side, moving inwardly, of the free end 2131 and is connected to a guiding slope surface 2232, to ensure smooth switching of the spring plate 21 between the natural state and the pressed state.

Particularly, in an embodiment, the housing 1 is provided with a plurality of mounting channels, and each mounting channel is correspondingly provided with the insertion hole 13, and the clamping and connecting piece 2 cooperating with the mounting channel. The spring plates 21 of the clamping and connecting piece 2 correspond to the mounting channels one by one, and the spring plates 21 are all assembled in one shared conductive sheet 22, to implement an efficient electrical connection. In addition, the spring plates 21 are integrally disposed by sharing the one support portion 211, thereby facilitating manufacturing, disassembly, and assembly.

Referring to FIG. 3, FIG. 9, FIG. 10, FIG. 11, and FIG. 12, the pressing piece 3 is rotatably assembled in the housing 1, the pressing piece 3 includes a pressing handle 31 and a pressing head 32 connected to the pressing handle 31, and the pressing handle 31 is hingedly connected to the housing 1 through cooperation of a rotating shaft 33, so that the pressing handle 31 is rotatable relative to the housing 1, to correspondingly drive the pressing head 32 to trigger the spring plate 21 to switch a status of the spring plate 21. It should be mentioned that the pressing piece 3 is hingedly connected to the housing 1 by using the rotating shaft 33, and the housing 1 is correspondingly provided with a mounting cavity 14 for accommodating the pressing piece 3, so that when the pressing piece 3 is in a first state, the pressing handle 31 of the pressing piece 3 can be horizontally assembled on the housing 1; when the pressing piece 3 is in a second state, the pressing handle 31 of the pressing piece 3 is pulled upwards to drive the pressing head 32 to rotate. The pressing head 32 abuts against the spring plate 21 throughout. Particularly, in this embodiment, the rotating shaft 33 is an irregular polygon and can rotate in the mounting cavity 14. When the pressing handle 31 is in the first state or the second state, corresponding sides of the rotating shaft 33 all abut against cavity walls of the mounting cavity 14, thereby limiting the pressing handle 31 to only perform switching between the first state and the second state. The rotating shaft 33 and the pressing head 32 are integrally disposed, and the rotating shaft 33 and the pressing head 32 are connected through smooth jointing.

In an embodiment, the pressing head 32 is linked to the spring plate 21 by using a limiting sheet 4. The limiting sheet 4 and the pressing head 32 are in a mutually abutting state throughout, and the limiting sheet 4 has a first location and a second location. At the first location, the limiting sheet 4 abuts against the pressing head 32; at the second location, the limiting sheet 4 prevents the pressing head 32 from continuing rotating along a rotation direction of the pressing handle 31, to limit an angle of upward or downward hinged rotation of the pressing handle 31. Both the first location 41 and the second location 42 are formed after the limiting sheet 4 relatively recesses inwardly to form a bending section, so that each bending section can abut against the pressing head 32 to limit each other. When the pressing piece 3 is in the first state, the pressing head 32 abuts against the first location 41 of the limiting sheet 4, and the pressing handle 31 is pulled upwards by a user to switch the pressing piece 3 to the second state. In this case, the pressing head 32 abuts against the second location 42 of the limiting sheet 4, to further limit the pressing piece 3 from being continuously pulled. Particularly, there are two pressing heads 32 that are oppositely disposed on two inner side surfaces of the pressing piece 3 at an interval. The limiting sheet 4 and the two pressing heads 32 are oppositely disposed, and respectively extend on two side surfaces of the clamping portion 213 of the spring plate 21, so that the pressing head 32 directly presses the clamping portion 213 by using the limiting sheet 4, thereby ensuring that the pressing head 32 abuts against the clamping portion 213 of the spring plate 21 throughout by using the limiting sheet 4. Therefore, the pressing head 32 moves to trigger the spring plate 21 to perform switching between the natural state and the pressed state.

In another embodiment, the limiting sheet 4 and the spring plate 21 are integrally formed, and extend on the two side surfaces of the clamping portion 213 of the spring plate 21, which is easy to manufacture and facilitates the pressing piece 3 directly pressing to trigger the spring plate 21.

Figure 2:
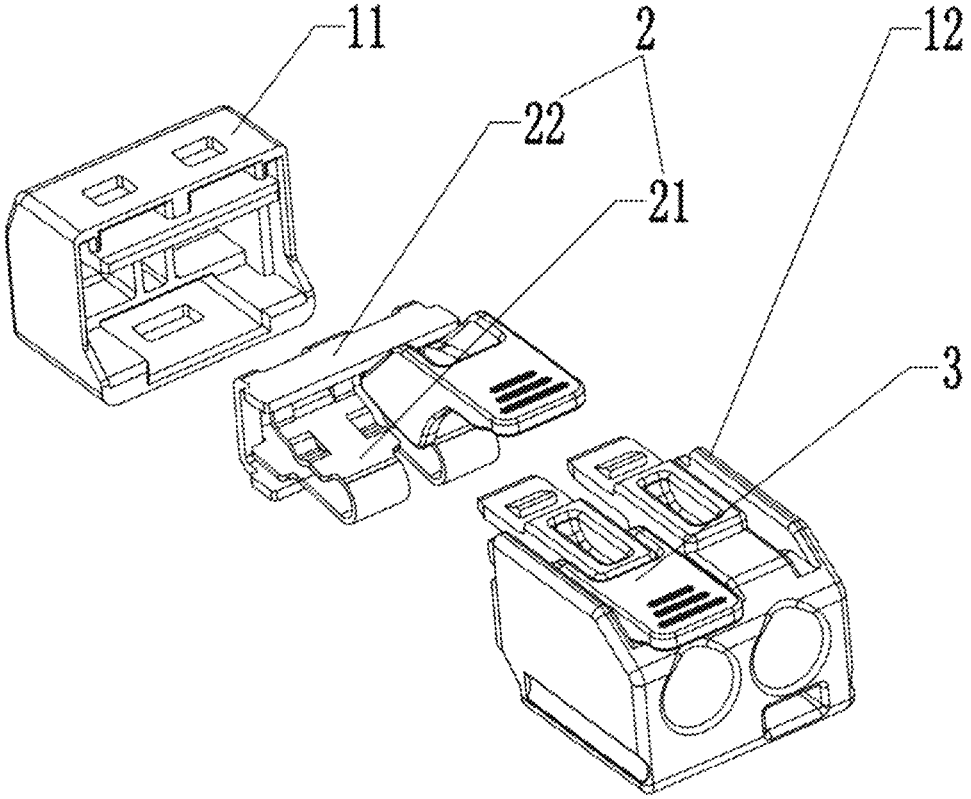
FIG. 2 is a partial schematic disassembly diagram of FIG. 1, where for ease of display, two pressing pieces in the figure are at different disassembly locations.
Figure 3:
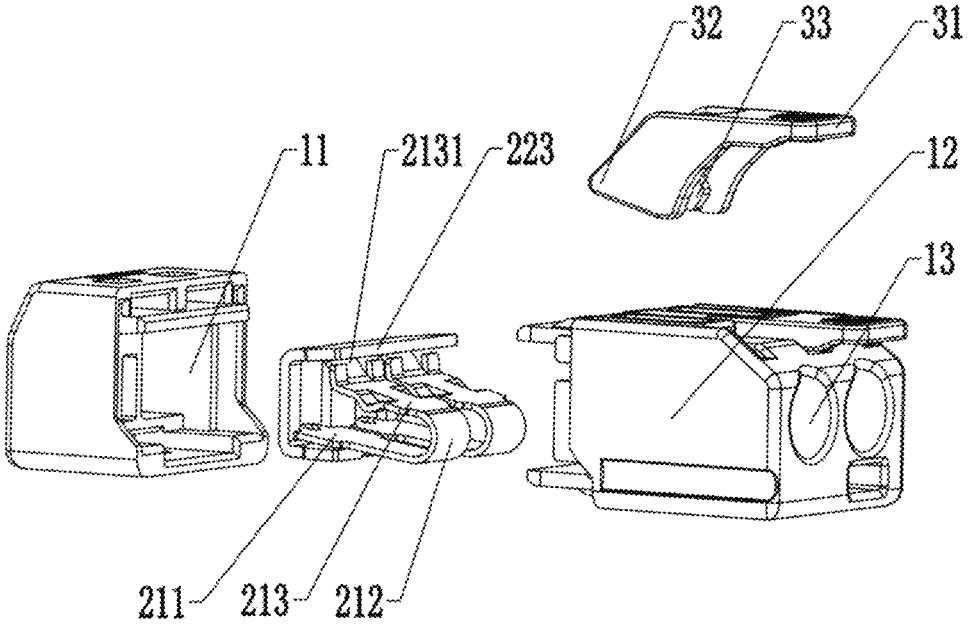
FIG. 3 is a schematic structural diagram of FIG. 2 from another perspective.
Figure 4:
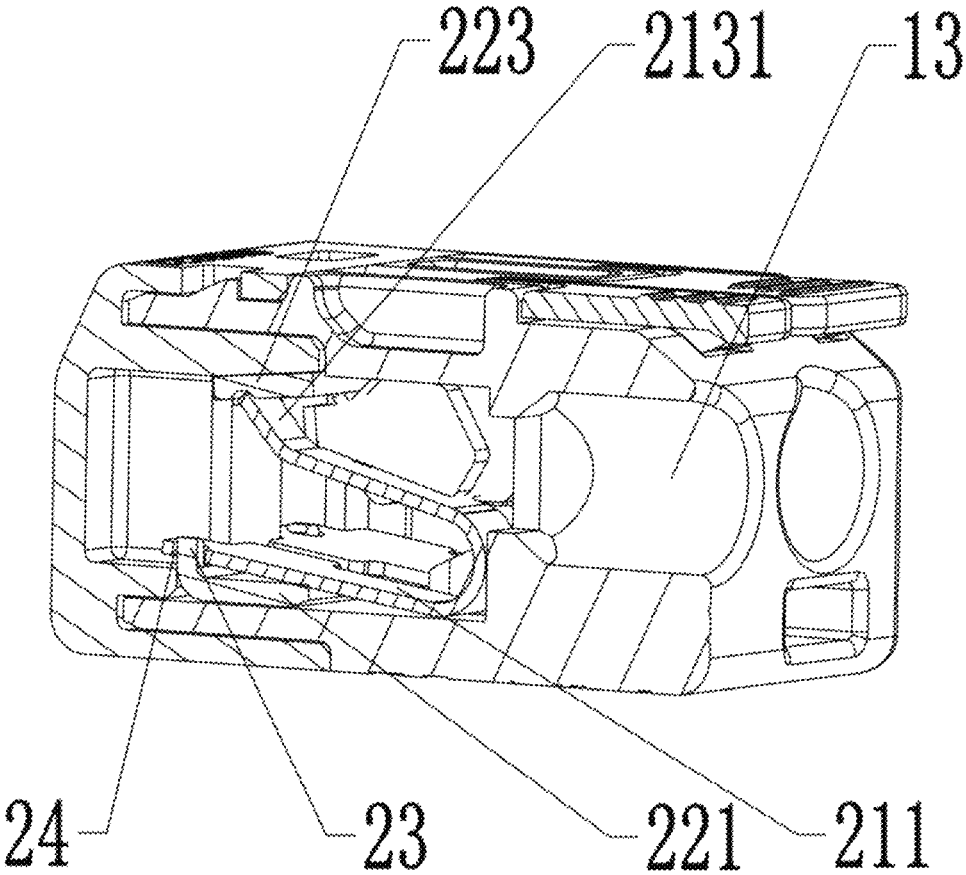
FIG. 4 is a sectional view of a wiring terminal on a plane according to an embodiment of the present invention.
Figure 5:
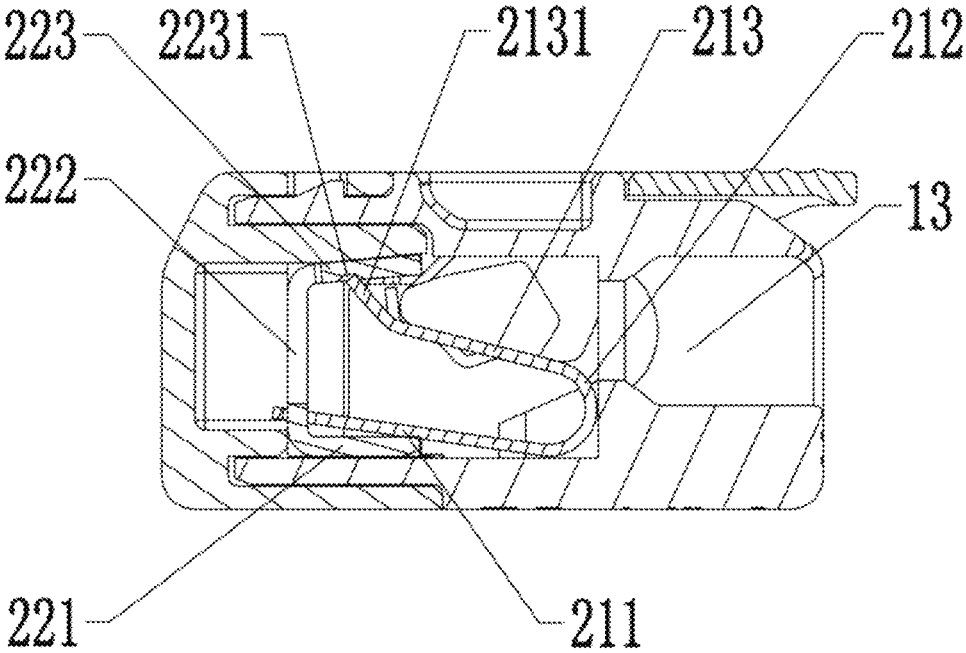
FIG. 5 is a sectional view of FIG. 4 from another perspective.
Figure 6:
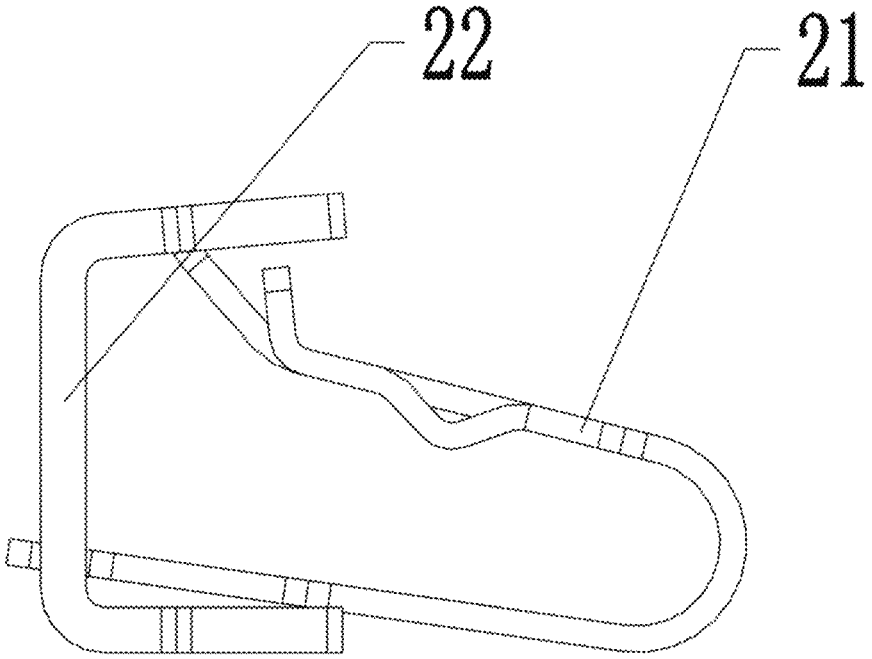
FIG. 6 is a schematic structural diagram of a clamping and connecting piece of a wiring terminal according to an embodiment of the present invention.
Figure 7:
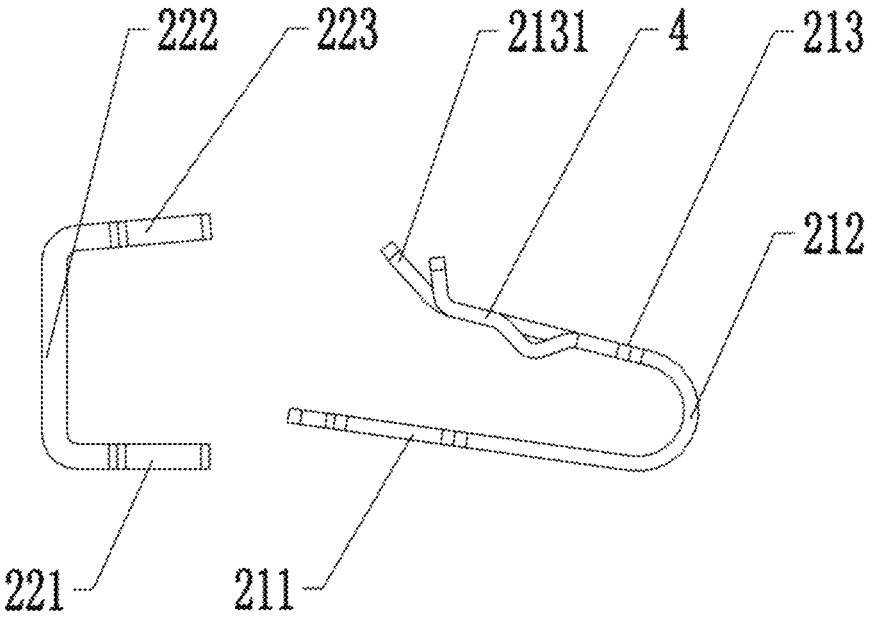
FIG. 7 is a schematic disassembly diagram of FIG. 6.
Figure 8:
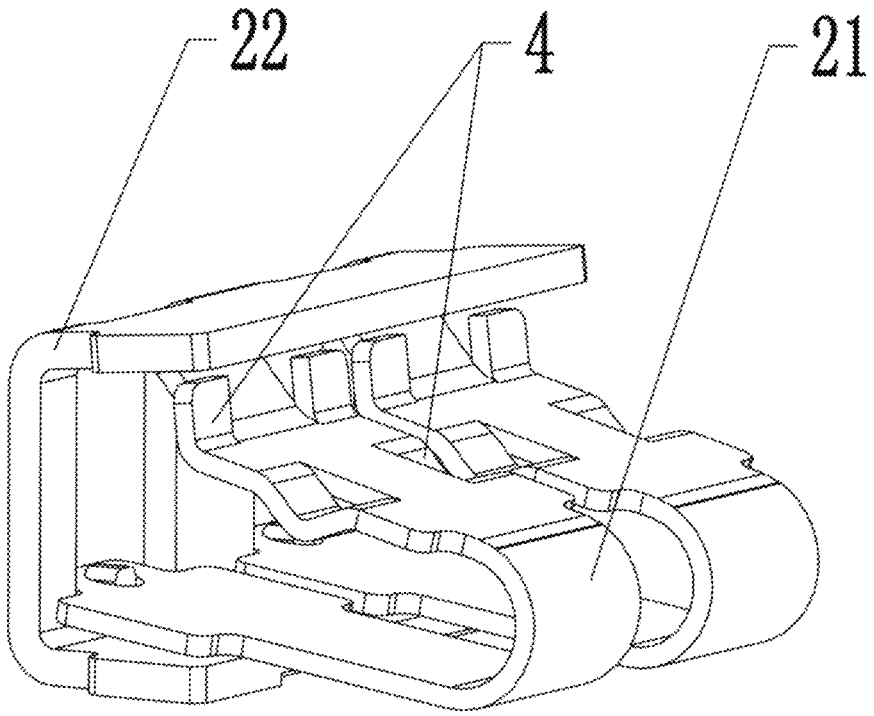
FIG. 8 is a schematic structural diagram of FIG. 6 from another perspective.
Figure 9:
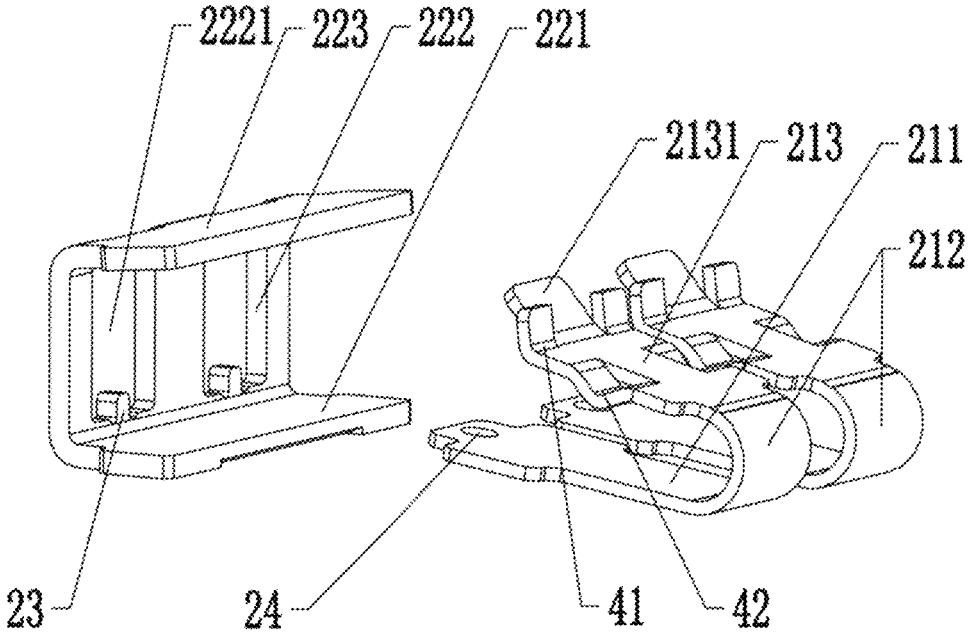
FIG. 9 is a schematic disassembly diagram of FIG. 8.
Figure 10:
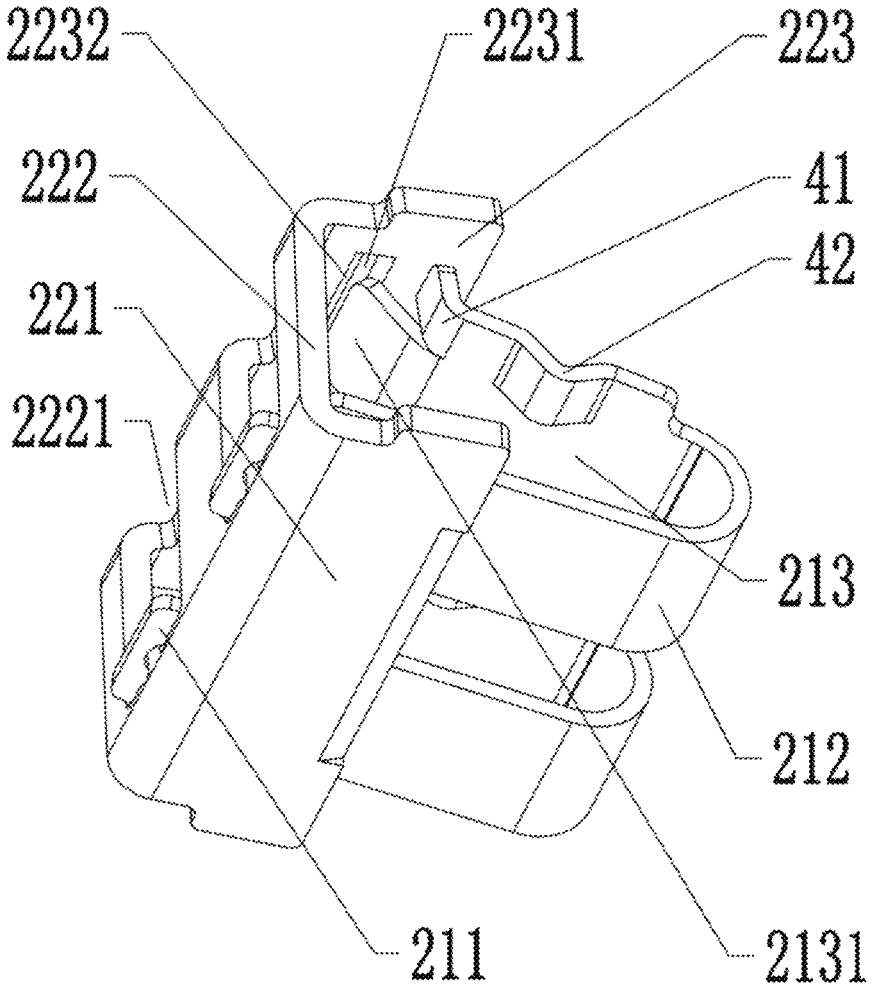
FIG. 10 is a schematic structural diagram of FIG. 8 from another perspective.
Figure 11:
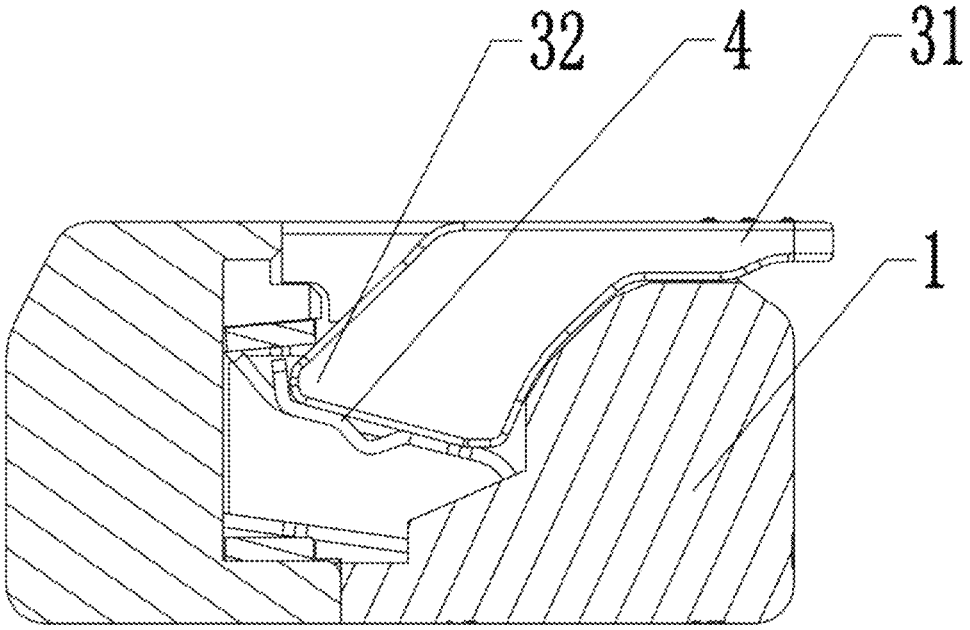
FIG. 11 is a sectional view of a wiring terminal on another plane according to an embodiment of the present invention.
Figure 12:
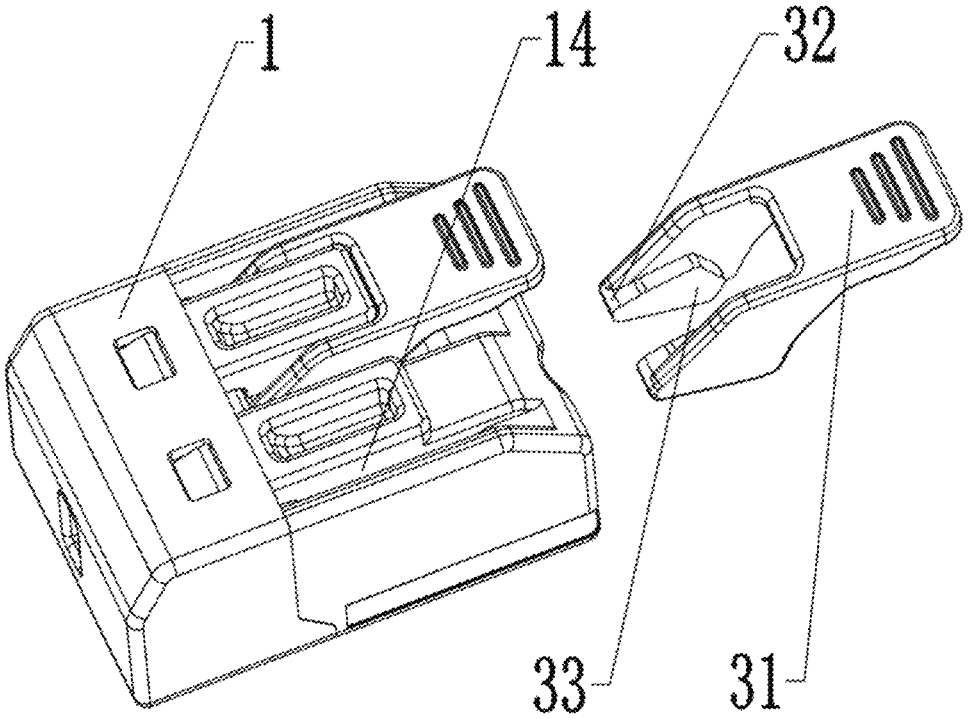
FIG. 12 is a partial schematic disassembly diagram of a wiring terminal according to an embodiment of the present invention, where signs: 1—housing; 11—front end cover; 12—rear end cover; 13—insertion hole; 14—mounting cavity; 2—clamping and connecting piece; 21—spring plate; 211—support portion; 212—bow-shaped portion; 213—clamping portion; 2131—free end; 22—conductive sheet; 221—mounting portion; 222—connecting portion; 2221—wire passing window; 223—conductive portion; 2231—limiting groove; 2232—guiding slope surface; 23—convex; 24—groove hole; 3—pressing piece; 31—pressing handle; 32—pressing head; 33—rotating shaft; 4—limiting sheet; 41—first location; 42—second location.

Referring to FIG. 2 and FIG. 3, the housing 1 includes a front end cover 11 and a rear end cover 12, the two end covers are assembled and connected by using a quick disassembly piece (not shown in the figure), and the insertion hole 13 is provided in the rear end cover 12, and is passable through, via the mounting channel, an inner cavity formed by assembling the two end covers. The quick disassembly piece may be disassembled and assembled through buckling, which is easy to perform maintenance. In another embodiment, an adsorption quick disassembly piece, a male-female quick disassembly piece, or the like may also be used, which are all extensions of this specification, and are not repeated herein.

The above is only some embodiments of the present disclosure, and is not intended to limit the present disclosure. To those of ordinary skill in the art, various modifications and changes can be made to the present disclosure. Any modifications, equivalent substitutions, improvements, etc. made within the spirit and scope of the present disclosure are intended to be included within the scope of the present disclosure.

What is claimed is:

1. A wiring terminal, used for receiving and connecting to a conducting wire, the wiring terminal comprising:

a housing, provided with a mounting channel and an insertion hole communicating with the mounting channel;

a clamping and connecting piece, configured in the mounting channel, wherein the clamping and connecting piece is provided with a curved spring plate for clamping the conducting wire and a conductive sheet cooperating with the spring plate; the spring plate has a natural state in which the conducting wire placed in the mounting channel is clamped between the spring plate and the conductive sheet through elastic abutment and a pressed state in which the spring plate is controlled by external force to deform in a direction distal from a clamped conducting wire; and a pressing piece capable of triggering the spring plate to switch between the natural state and the pressed state, wherein the conducting wire is capable of passing through the insertion hole and clamped in the clamping and connecting piece; the pressing piece triggers the spring plate to switch from the natural state to the pressed state, to unclamp the conducting wire, so that the conducting wire is detachable from the clamping and connecting piece;

wherein the pressing piece is rotatably assembled in the housing, the pressing piece comprises a pressing handle and a pressing head connected to the pressing handle, and the pressing handle is hingedly connected to the housing through cooperation of a rotating shaft, so that the pressing handle is rotatable relative to the housing, to drive the pressing head to trigger the spring plate to switch a status of the spring plate;

wherein the pressing head is linked to the spring plate by using a limiting sheet, the limiting sheet and the pressing head are in a mutually abutting state throughout, and the limiting sheet has a first location for abutting against the pressing head and a second location for preventing the pressing head from continuing rotating along a rotation direction of the pressing handle, to limit an angle of upward or downward hinged rotation of the pressing handle.

2. The wiring terminal according to claim 1, wherein the spring plate and the conductive sheet form a ring-shaped bend; an end portion of the spring plate is connected to an inner end surface of the conductive sheet through elastic abutment, and the conducting wire is clamped between the spring plate and the conductive sheet.

3. The wiring terminal according to claim 2, wherein the spring plate is U-shaped, and comprises a support portion leaning against the conductive sheet, a bow-shaped portion connected to the support portion, and a clamping portion that is connected to the bow-shaped portion and is provided with a free end in a direction of the conductive sheet; the conductive sheet is C-shaped, and comprises a mounting portion that fits and clamps the support portion, a connecting portion connected to the mounting portion, and a conductive portion that is connected to the connecting portion and abuts against the free end of the clamping portion.

4. The wiring terminal according to claim 3, wherein the bow-shaped portion and the connecting portion are disposed opposite to each other, and the clamping portion is obliquely disposed, so that an included angle less than 90° is formed between the free end of the clamping portion and the conductive portion.

5. The wiring terminal according to claim 3, wherein the connecting portion is provided with a wire passing window along the mounting channel, the support portion is passable through the wire passing window to close-fit the mounting portion, and the support portion fits the mounting portion through buckling for fixing; at least a part of the support portion extends out of the wire passing window along an insertion direction of the conducting wire.

6. The wiring terminal according to claim 3, wherein an inner end surface, corresponding to the free end of the clamping portion, of the conductive portion is provided with a limiting groove; when the spring plate is in the natural state, the free end is clamped and limited in the limiting groove, and the limiting groove is transitionally connected to a guiding slope surface along a direction in which the free end detaches from the limiting groove.

7. The wiring terminal according to claim 3, wherein the housing is provided with a plurality of mounting channels, insertion holes corresponding to the mounting channels, and the clamping and connecting piece, wherein spring plates of the clamping and connecting piece correspond to the mounting channels one by one, and the spring plates are all assembled in one shared conductive sheet; and the spring plates are integrally disposed by sharing the one support portion.

8. The wiring terminal according to claim 1, wherein the housing comprises a front end cover and a rear end cover, the two end covers are assembled and connected, and the insertion hole is provided in the rear end cover, and an inner cavity is formed by assembling the two end covers.

* * * * *